US010475316B1

(12) United States Patent
Scott et al.

(10) Patent No.: US 10,475,316 B1
(45) Date of Patent: Nov. 12, 2019

(54) LOSS PREVENTION SYSTEM

(71) Applicant: SecuriTime, LLC, Cloverdale, VA (US)

(72) Inventors: Jerry Scott, Cloverdale, VA (US); Chris Copenhaver, Cloverdale, VA (US); Patrick Henderson, Cloverdale, VA (US); Cameron Tabor, Cloverdale, VA (US)

(73) Assignee: Securitime, LLC, Daleville, VA (US)

( * ) Notice: Subject to any disclaimer, the term of this patent is extended or adjusted under 35 U.S.C. 154(b) by 0 days.

(21) Appl. No.: 15/682,620

(22) Filed: Aug. 22, 2017

Related U.S. Application Data

(60) Provisional application No. 62/381,391, filed on Aug. 30, 2016.

(51) Int. Cl.

| | |
|---|---|
| ***G08B 13/24*** | (2006.01) |
| ***G08B 25/00*** | (2006.01) |
| *G08B 29/18* | (2006.01) |

(52) U.S. Cl.
CPC ..... *G08B 13/248* (2013.01); *G08B 25/001* (2013.01); *G08B 29/185* (2013.01)

(58) Field of Classification Search
None
See application file for complete search history.

(56) References Cited

U.S. PATENT DOCUMENTS

| | | | | |
|---|---|---|---|---|
| 9,008,691 | B2 | 4/2015 | Busch | 4/28 |
| 2010/0277300 | A1* | 11/2010 | Cohn | G08B 29/02 340/506 |
| 2011/0082729 | A1 | 4/2011 | Carvallo et al. | 705/14.13 |
| 2014/0108149 | A1 | 4/2014 | Jabara et al. | 30/267 |
| 2014/0282620 | A1 | 9/2014 | Nuovo et al. | 9/542 |
| 2015/0278873 | A1 | 10/2015 | Sylvester | 30/267 |
| 2015/0281236 | A1 | 10/2015 | Batta et al. | 63/10 |
| 2015/0310460 | A1 | 10/2015 | Tesanovic et al. | 30/201 |
| 2017/0352255 | A1* | 12/2017 | Sweeney | G08B 25/08 |
| 2018/0025616 | A1* | 1/2018 | Lin | G08B 29/185 |

* cited by examiner

*Primary Examiner* — Leon Viet Q Nguyen
(74) *Attorney, Agent, or Firm* — MacCord Mason PLLC

(57) ABSTRACT

An incident survey system. The incident survey system includes a site loss prevention system and a RF survey system. The RF survey system includes (i) at least one device for receiving RF signals from remote devices having a unique MAC address, (ii) an interface for connecting the site loss prevention system to the RF survey network and (iii) a data logger adapted for storing information received by the device. An interface connects the site loss prevention system to the RF survey network. In addition, a monitoring service may be used for responding to a triggering event reported by the site loss prevention system.

45 Claims, 8 Drawing Sheets

LOSS PREVENTION SYSTEM

BACKGROUND OF THE INVENTIONS

(1) Field

The present invention relates generally to security systems and, more particularly, to a system for identifying and analyzing data transmitted using a radio frequency (RF) from a remote device that may be associated with a triggered event in a predefined area in conjunction with a system or systems designed for the purpose of preventing loss.

(2) Related Art

Current security systems employ surveillance cameras and/or various sensors to detect and record the presence of criminal activity within a location. In residences, security companies typically provide an alarm box connected to a monitoring service, wherein the alarm box may be triggered if an entrance door is opened and an input code is not provided within the allotted time. In retail locations, various sensors may be utilized for loss prevention purposes. For example, most retailers include electronic article surveillance tags with merchandise that alerts loss prevention personnel of individuals attempting to steal the tagged merchandise. Security systems are not necessarily limited to alerting users of criminal activity. Other sensors, such as fire or smoke detector sensors may also be employed to alert occupants of an imminent/ongoing environmental danger within a building.

Without surveillance cameras installed, it can be difficult to identify individuals responsible for criminal activities unless there are eyewitnesses or other incriminating evidence. The probability of identifying the individual greatly decreases once he/she leaves the building undetected. Surveillance cameras can help alleviate this problem by having a visual record of virtually all individuals within a building, including at the time of any criminal activity. However, there are several issues with surveillance cameras. For example, the activity may occur at a location where a video feed is unavailable because a surveillance camera is not installed at a particular location within the building. If a video feed is available, it may still be difficult to identify the individual if the image resolution is inadequate or the individual has obscured his/her identifying features. Another problem is that the criminal activity may not even be detected until after the surveillance records have been discarded. There is also the obstacle of obtaining the actual identity of the individual within a video feed.

Currently available security systems can only respond to an event after it has occurred and are not capable of alerting security personnel of an increased security risk so that further preventative measures to be taken.

Thus, there remains a need for improving identification measures of individuals occupying a building and for alerting occupants of a potential security risk, while at the same time, being compatible and interoperable with pre-existing security systems on- and off-site.

SUMMARY OF THE INVENTIONS

The present inventions are directed to an incident survey system. The incident survey system includes a site loss prevention system and an RF survey system. The RF survey system includes (i) at least one device for receiving RF signals from remote devices having a unique MAC address, (ii) an interface for connecting the site loss prevention system to the RF survey network and (iii) a data logger adapted for storing information received by the device. An interface connects the site loss prevention system to the RF survey network. In addition, a monitoring service may be used for responding to a triggering event reported by the site loss prevention system.

The RF receiving device may be adapted to receive signals selected from the group consisting of Bluetooth, RFID, Wi-Fi, cellular transmissions, and combinations thereof.

In one embodiment, the RF receiving device includes a housing, an antenna, a power supply, at least one controller chip connected to RAM and ROM memory, and at least one network port. The survey system also may further includes LEDs adapted to report the status of the signals on the RF receiving device. Also, the network port may be a wide area network port.

In one embodiment, the interface comprises a transmitter connected to an output of the site loss prevention system and a receiver connected to an input of the RF receiving device. The transmitter and the receiver may be wireless.

The interface may be connected to the site loss prevention system by an IP network. The network may be a local network. The network may also be wireless.

In one embodiment, the interface is an applications program interface adapted to receive data from the RF receiving device and the site loss prevention system and send data to a monitoring service.

In one embodiment, the data logger is remotely located. The data logger may also store information to the storage device at predefined time intervals.

The survey system may further include a data analyzer adapted to view and perform operations on information stored on the data logger. In one embodiment, the data analyzer creates a device profile associating a remote device with a triggering event. The data analyzer may associate information received from the site loss prevention system with the remote device profile.

Also, the remote device profile may be stored in a database. The database may be shared and accessible to at least one other remote incident survey system. Also, the RF receiving device may detect the remote device having the device profile created by the other remote incident survey system. In addition, the survey system may further include a user interface for perfoiming tasks with the data analyzer. The user interface may include a camera specific overlay. The user interface may be a site specific overlay.

In one embodiment, the monitoring service is a remote monitoring system located off-site from the site loss prevention system.

The monitoring service may be adapted to execute a response to the triggering event automatically based on predefined conditions.

The monitoring service may share information from the triggering event with another remote site.

The monitoring service may provide analytical and predictive reporting on data collected from the triggering event.

In one embodiment, the site loss prevention system includes at least one trigger device and an event monitoring system. The event monitoring system may provide an event output signal in response to an input signal from the trigger device. In one embodiment, at least one trigger device includes a plurality of sensors throughout the site premises. The sensors may be selected from the group consisting of electronic article surveillance sensors, fire detector sensors, motion sensors, glass break sensors, magnetic sensors, smoke detector sensors, water flow sensors, HVAC monitor sensors, heat sensors, duct air flow sensors, temperature sensors and combinations thereof. Also, the site loss prevention system includes at least one surveillance camera on the site premises adapted to receive video signals and relay the video signals to said event monitoring system.

Accordingly, one aspect of the present inventions is to provide an incident survey system including (a) a site loss prevention system; (b) a RF survey system including at least one device for receiving RF signals from remote devices having a unique MAC address; and (c) an interface for connecting the site loss prevention system to the RF survey network.

Another aspect of the present inventions is to provide a RF survey system for an incident survey system for a site loss prevention system, the RF survey system including (a) at least one device for receiving RF signals from remote devices having a unique MAC address; (b) an interface for connecting the site loss prevention system to the RF survey network; and (c) a data logger adapted for storing information received by the device.

Still another aspect of the present inventions is to provide an incident survey system including (a) a site loss prevention system; (b) a RF survey system including (i) at least one device for receiving RF signals from remote devices having a unique MAC address (ii) an interface for connecting the site loss prevention system to the RF survey network and (iii) a data logger adapted for storing information received by the device; (c) an interface for connecting the site loss prevention system to the RF survey network; and (d) a monitoring service for responding to a triggering event reported by the site loss prevention system.

These and other aspects of the present inventions will become apparent to those skilled in the art after a reading of the following description of the preferred embodiment when considered with the drawings.

DESCRIPTION OF THE EMBODIMENTS

Figure 1:
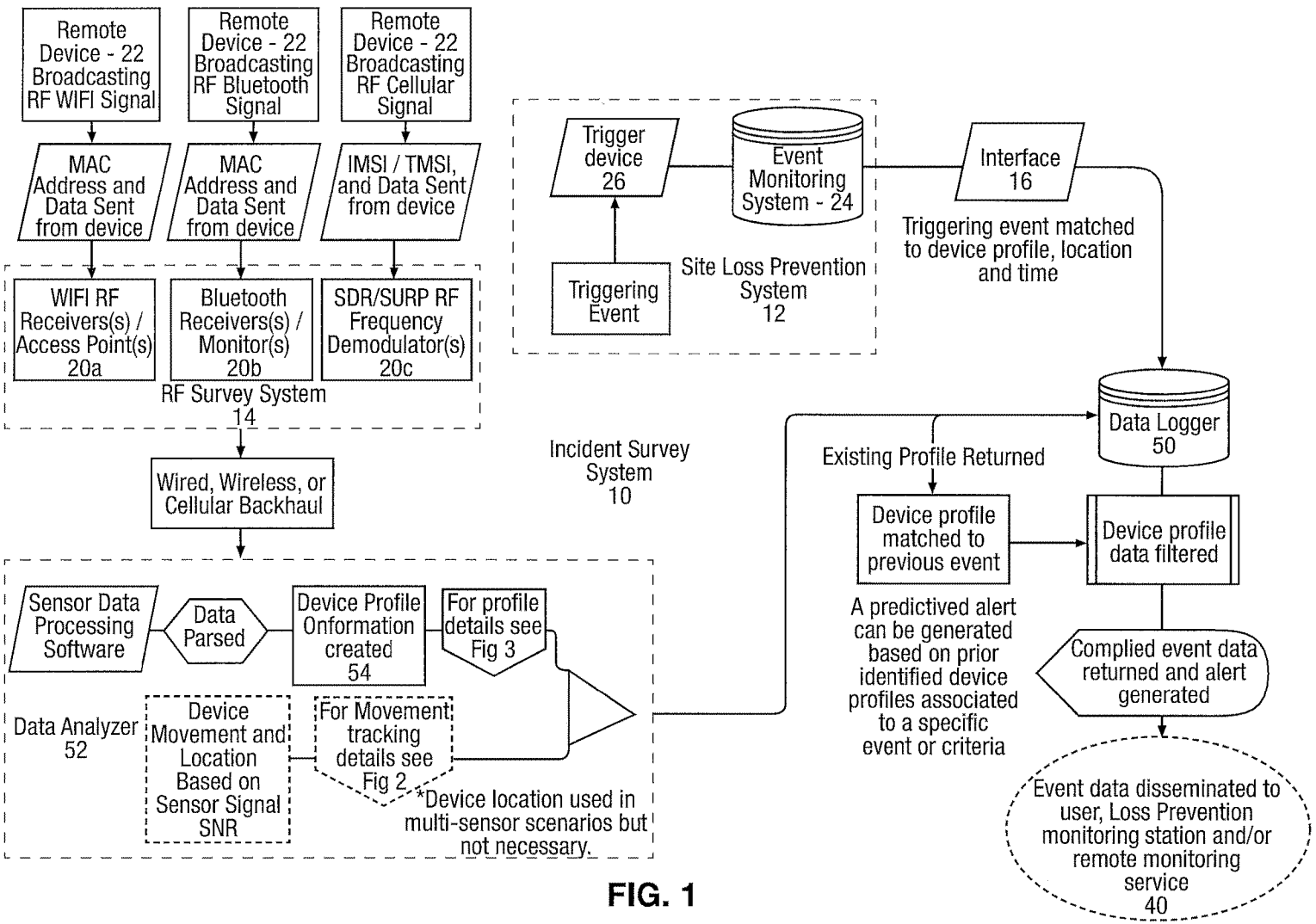
FIG. 1 is a block diagram illustrating an overview of an incident survey system constructed according to one embodiment of the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an incident survey system, generally designated 10, is shown constructed according to the present inventions. The incident survey system 10 includes a site loss prevention system 12, an RF survey system 14, and an interface 16 for connecting site loss prevention system 12 with RF survey system 14. RF survey system 14 includes at least one device 20 adapted to receive radio frequency (RF) signals from remote devices having a unique MAC address.

As shown in FIG. 1, RF survey system 14 may comprise a plurality of RF-receiving devices, such as a Wi-Fi receiver 20*a*, a Bluetooth receiver 20*b*, and a SDR (software-defined radio) RF frequency demodulator 20*c*. The SDR RF frequency demodulator may comprise a universal software radio peripheral (USRP). The RF survey system 14 is configured to receive the MAC addresses and data from remote devices broadcasting a signal when within range of device 20. For example, as seen in FIG. 1, a remote device 22 broadcasting a Bluetooth signal may enter the range of Bluetooth receiver 20*b* wherein receiver 20*b* stores the remote device's MAC address and other data broadcasted through the Bluetooth signal. Remote device 22 may be any device capable of emitting a RF signal, such as a laptop, smartphone, or Bluetooth headset. If remote device 22 broadcasts more than one signal, then a plurality of receivers 20 may be used to detect and store data from each respective signal. By way of example, remote device 22 may comprise a smartphone broadcasting a Wi-Fi signal for accessing the internet, a Bluetooth signal for pairing with accessories, and a cellular signal for service.

As shown in FIG. 1, the cellular signal may include a temporary mobile subscriber identity (TMSI) or international mobile subscriber identity (IMSI). Other unique identification data may be broadcasted, including international mobile equipment identity numbers (IMEI) and mobile subscriber integrated services digital network number (MSIDN). This data is then stored and may be matched to other information from the remote device such as signal strength, and signal to noise ratio changes. This information may also be used to correlate the movement of remote device 22 in proximity to receiver 20. Other unique data pack information, such as service set identifier (SSID) broadcast beacons, may also be captured and stored.

Figure 7A:
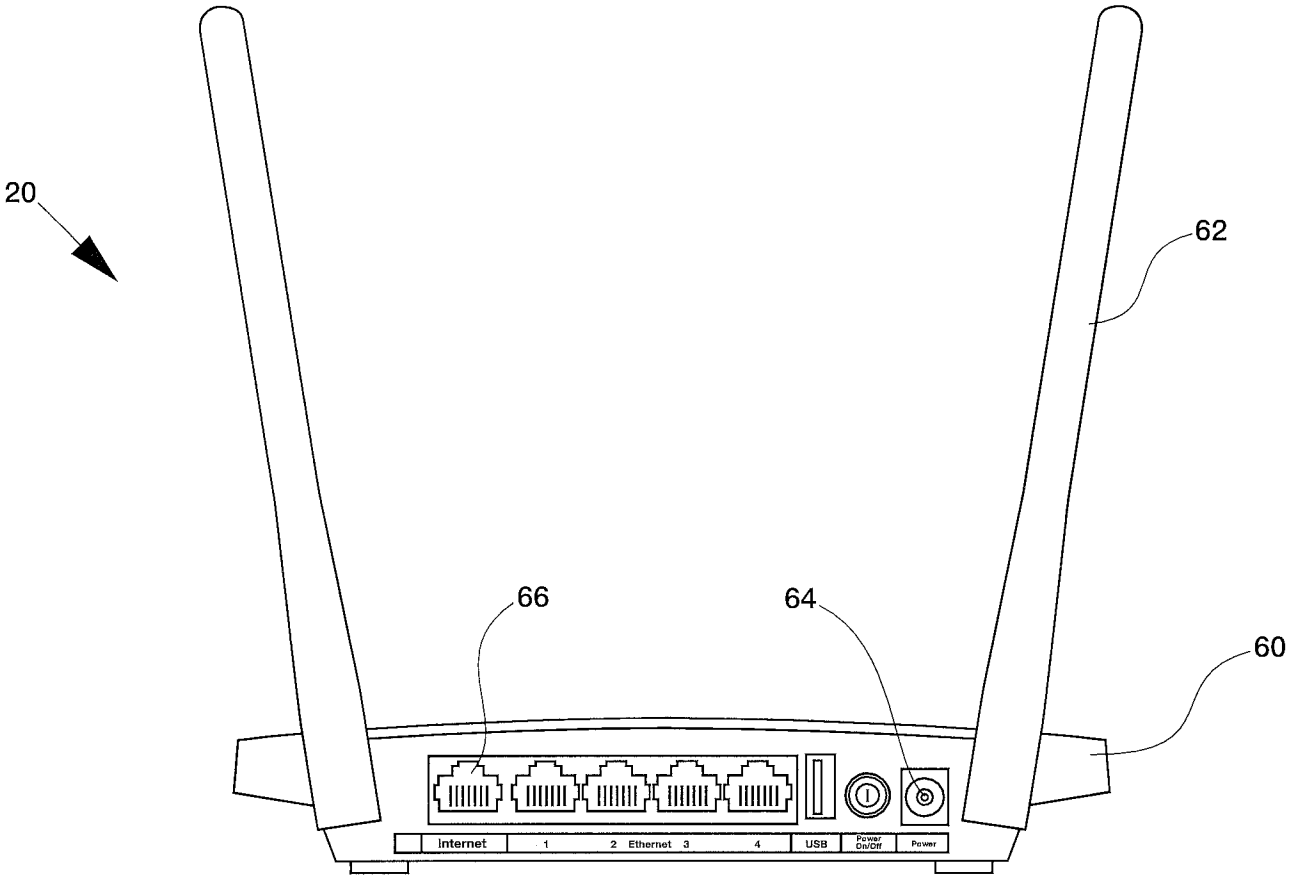
FIG. 7A is a rear view of a RF receiving device according to one embodiment.
Figure 7B:
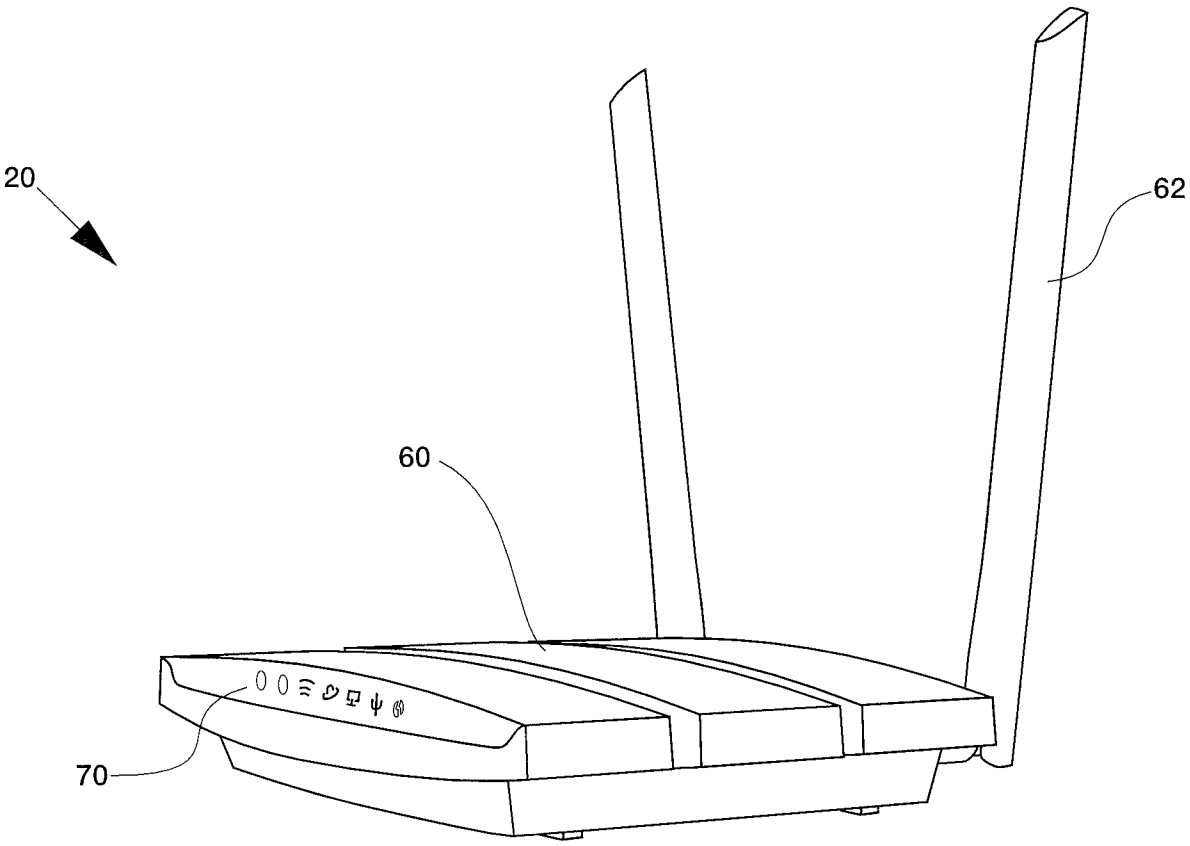
FIG. 7B is an overhead perspective view of the RF receiving device shown in FIG. 7A.

FIGS. 7A and 7B show one example of a RF receiving device 20 capable of receiving Wi-Fi signals from a remote device 22. The RF receiving device 20 typically includes a housing 60, an antenna 62, a power supply 64, at least one controller chip connected to RAM and ROM memory, and at least one network port 66. For example, the network port may be a wide area network port. RF receiving device 20 may be adapted to receive signals including Bluetooth, RFID, Wi-Fi, cellular transmissions, and combinations thereof. LEDs 70 may also be included with the RF survey system to report the status of signals on RF receiving device 20.

Site loss prevention system 12 may include one or more trigger devices 26 and an event monitoring system 24. For example, event monitoring system 24 may be an alarm box configured to activate an alarm in response to an event identified by trigger device 26. Other examples of an event monitoring system may include software-managed monitoring systems such as camera systems or personal home security systems. Event monitoring system 24 is responsible for providing an event output signal in response to an input signal from trigger device 26. In one embodiment, trigger device 26 includes a plurality of sensors throughout the site premises where site loss prevention system 12 is located. Examples of sensors that trigger device 26 may utilize include electronic article surveillance sensors, fire detector sensors, motion sensors, glass break sensors, magnetic sensors, smoke detector sensors, water flow sensors, HVAC monitor sensors, heat sensors, duct air flow sensors, temperature sensors and combinations thereof. Moreover, site loss prevention system 12 may additionally include one or more surveillance cameras on-site for receiving video signals and relaying them to event monitoring system 24. Setting off trigger device 26 results in a triggering event.

One example of interface 16 is an applications program interface adapted to receive data from RF receiving device 20 and said site loss prevention system 12 and send data to monitoring service 40. In one embodiment, interface 16 includes a transmitter connected to an output of site loss prevention system 12 adapted to send information regarding a triggering event to a receiver connected to an input of RF receiving device 20. In some examples, transmitter and receiver are wireless, and interface 16 may connect to site loss prevention system 12 by an IP network. The IP network may be a local network. The network may be wireless. Alternatively, a cellular transmission device may also be employed which can linked via a remote or local data network. Yet in another embodiment, interface 16 may include a wired interface wherein the output of the event monitoring system 24 and the input of interface 16 are directly wired for communication.

As seen in the embodiment of FIG. 1, incident survey system 10 includes a data logger 50 adapted for storing information transmitted by RF receiving device 20. Data logger 50 may be located on-site or may be remotely located elsewhere. Data logger 50 may be programmed to store information to a storage device at predefined time intervals. The incident survey system 10 may be further equipped with a data analyzer 52 adapted to view and perform operations on information stored by data logger 50. Tasks may be performed on data analyzer 52 through a user interface. The user interface may include a variety of features, including a camera specific overlay and/or a site specific overlay.

Data analyzer 52 may operate by creating a device profile 54 associating a remote device 22 with a triggering event. Data analyzer 52 may then associate information received from site loss prevention system 12 with the device profile 54. Device profiles 54 created by data analyzer 52 may be stored in a database. Storing device profiles 54 in a database may be useful for sharing with other remote incident survey systems. For example, RF receiving device 20 of incident survey system 10 may detect a remote device 22 having a device profile 54 created by a remote incident survey system.

All stored data on data logger 50 may be continuously streamed to a shared database, such as a central cloud database and monitoring engine, at a configured interval for access by other remote incident survey systems. The interval may be of any defined time span. For example, the configured interval may be 1 minute or 1 hour. In some instances, the interval may be configured by an end-user, or by a security company offering the incident survey system to manage network bandwidth. For instance, a mall would consume significant bandwidth sending from all devices each minute, whereas an antique shop likely would only have a few devices in proximity.

Figure 2:
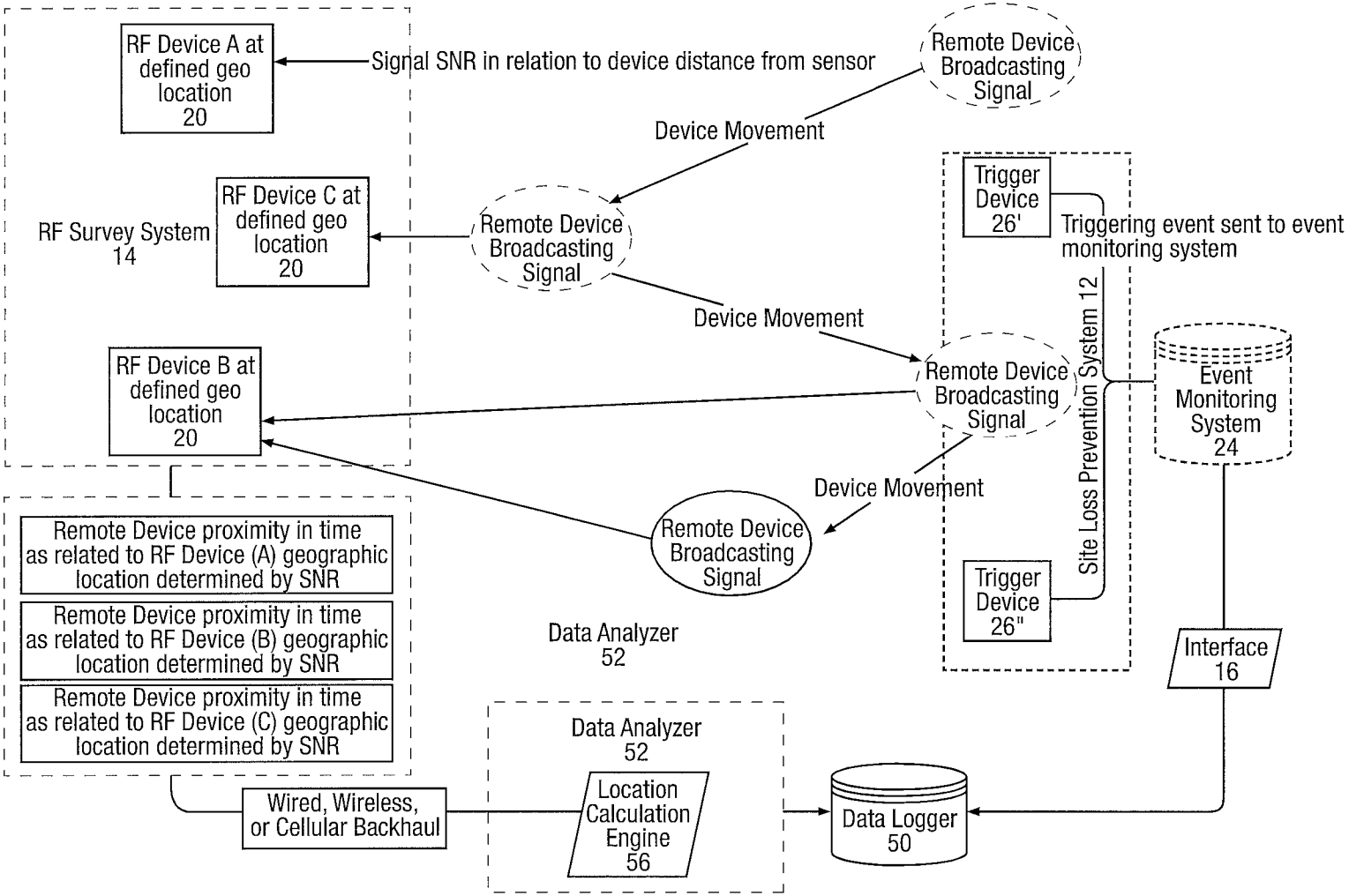
FIG. 2 is a block diagram illustrating one example of tracking the location of a remote device emitting a RF signal.

FIG. 2 illustrates an example of how site loss prevention system 12 and RF survey system 14 collect and store data to data logger 50. Site loss prevention system 12 includes trigger devices 26, installed in various locations at a site that are connected to event monitoring system 24. Upon a triggering event detected by trigger device 26, event monitoring system 24 can store information from the triggering event, including the trigger sensor that detected the triggering event and associated time stamp, to data logger 50 through interface 16. RF survey system 14 includes multiple RF receiving devices 20 installed at defined geographic locations at the site. As remote device 22 emitting one or more RF signals approaches the range of a RF receiving device 20, received data is sent from RF receiving device 20 to a data logger 50. The data may be sent via a wired, wireless, or cellular backhaul. Prior to sending the data directly to data logger 50, the data may be sent from RF receiving device 20 to data analyzer 52, wherein one or more analyses are perfoinied and the results sent to data logger 50 along with the received data from RF receiving device 20.

Returning to FIG. 2, the remote device's unique identification data, along with the geographic location from the RF receiving device 20 and the time that remote device 22 entered the RF receiving device's range, are stored together in data logger 50. Data analyzer 52 may include a location calculation engine 56 to correlate time and geographic data from remote device 22 over the multiple RF receiving devices and store results into device profile 54 at data logger 50. For example, the geographic location of remote device 22 may be calculated by comparing the signal to noise ratio (SNR) with one or more RF receiving devices 20, with a stronger signal indicating that remote device 22 is closer to a RF receiving device 20. Accuracy in determining the geographic location of remote device 22 may be improved by comparing the SNR with respect to multiple RF receiving devices 20. In conjunction with location calculation engine 56, RF survey system 14 can determine the location and time for remote device 22, and can associate that information with unique identification data of remote device 22 for storage into data logger 50.

Remote devices identified as being in proximity to a triggering event are given a device profile 54 using MAC addresses or other unique identification information. Device profiles help correlate remote devices with past or current triggering events. Device profiles are stored in data logger 50 for future analysis and may be on a shared database accessible to other incident survey systems to assist in monitoring or help reduce risk or prevent loss. Each device profile may be assigned different levels of severity by the data analyzer. For example, an algorithm may be used to assign risk levels based on correlations of the remote device with triggering events and how much time has passed since the last triggering event for the remote device. These risk levels may be relayed to an incident survey system whenever the remote device enters a location having an incident survey system with access to the device profile, whether the device profile is stored on an on-site data logger or on a shared database.

Figure 3:
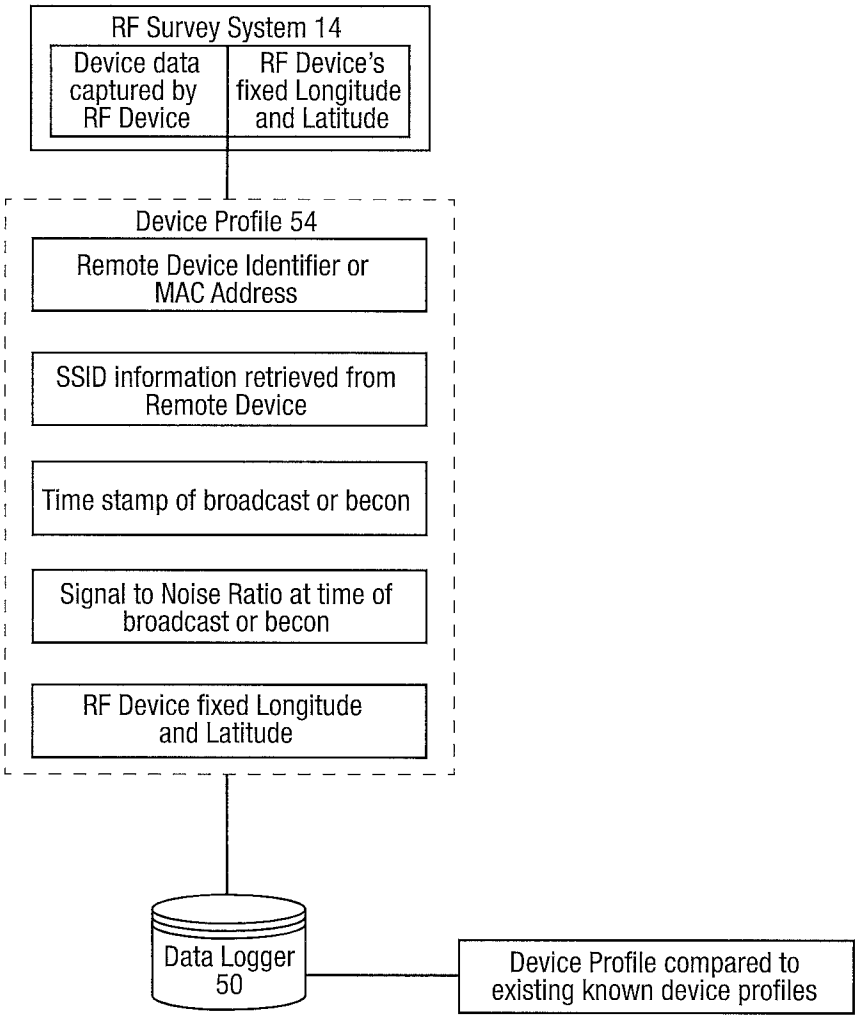
FIG. 3 is a block diagram illustrating one example of creating and storing a device profile for a remote device.

FIG. 3 illustrates an example of data that may be associated with a device profile. Device profile 54 includes unique identification data from remote device 22, such as its MAC address, to distinguish device profiles from one another. Within device profile 54 of remote device 22, other information may be linked including location data and a time stamp of when remote device 22 enters the range of a RF receiving device 20. All identifying information broadcasted by remote device 22 may be stored onto device profile 54.

As the information is collected for remote device 22, it is compared to existing known device profiles in data logger 50. If the unique identification data indicates that remote device 22 has a pre-existing profile, then the additional information (i.e., location and time stamp data) may be added to the pre-existing profile. Similarly, data collected from remote device 22 may also be compared to device profiles on a shared cloud database created by other remote incident survey systems, and compiled with those device profiles if a match is found.

Figure 4:
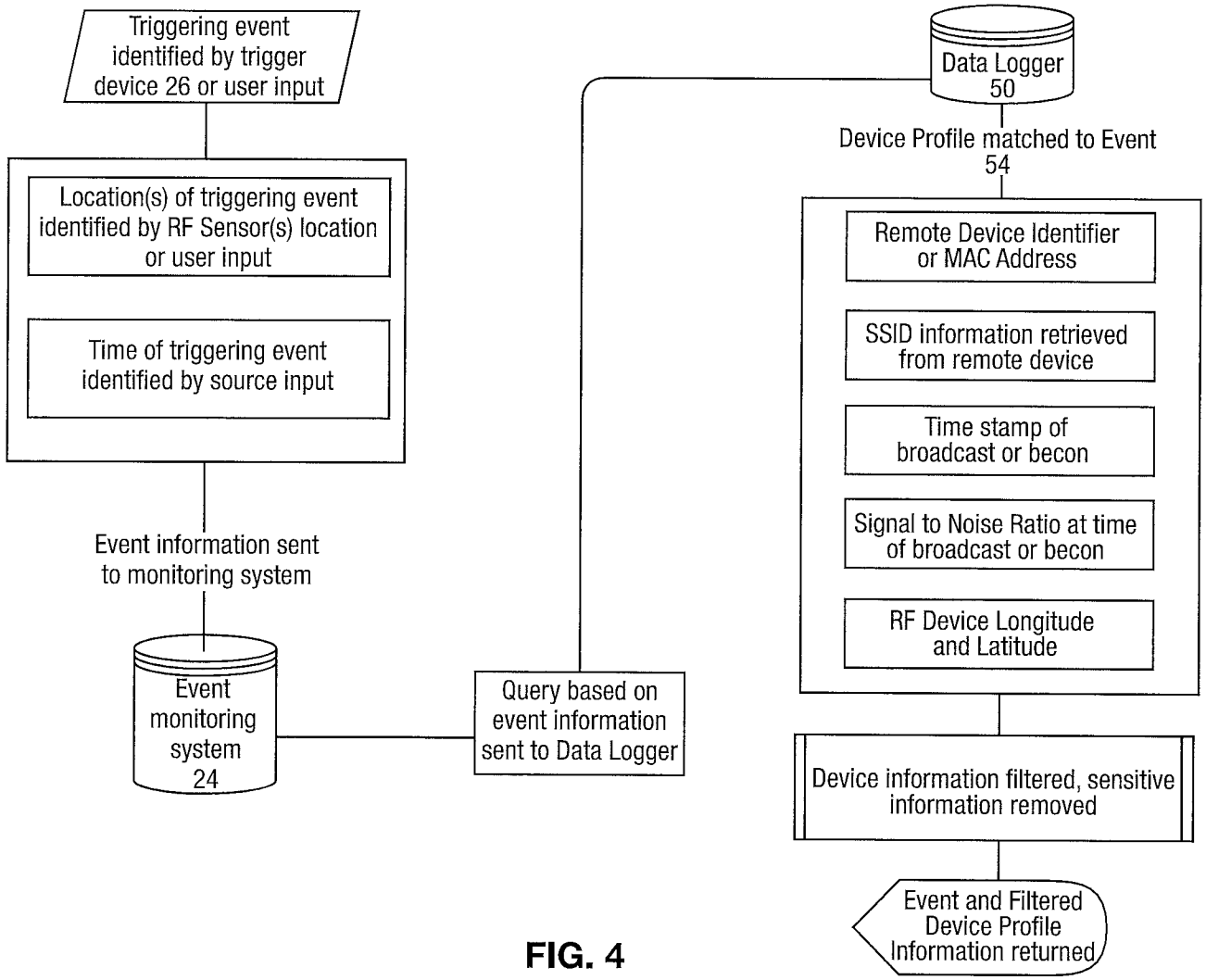
FIG. 4 is a flow chart illustrating a response to a triggering event.

Referring now to FIG. 4, a flow chart is shown illustrating one example of how incident survey system 10 responds to a triggering event. Triggering events may be identified by a trigger device 26. Alternatively, or in addition to, triggering events may also be identified by user input. For instance, loss prevention teams may identify any arbitrary point in time during the data retention period to create a triggering event. A triggering event may be any event at the location where the team determines the devices in proximity should be considered for future analysis. For example, at a retail store, the manager determines that during nightly inspection that a television has gone missing from the display area. He remembers seeing the television when he did his afternoon inspection. He can use incident survey system 10 to create a triggering event of the time period between his afternoon inspection and when he noticed the television was missing.

Once a triggering event is identified, event information is sent to event monitoring system 24. Event information may include the location of the triggering event and the time span of the triggering event. Location data may be user-defined, or may be defined as the location of the trigger device 26 that identified the triggering event. The time span may also be user-defined, or may be defined by the time that the triggering device identified the triggering event. The time span may simply be a time stamp or a range of values.

A query may be sent to data logger 50 based on the triggering event information provided by the event monitoring system. All relevant device profiles and corresponding information are then filtered and provided based off input provided by the event monitoring system. For example, data logger 50 may provide all relevant device profiles corresponding to the time, location, or both for a triggering event. The device profiles may be further filtered to protect potentially sensitive information captured from a remote device. Data logger 50 may also associate and store triggering event information for all relevant device profiles. By way of example, a query based on a triggering event may correspond to a number of remote devices identified by RF survey system 14 as present in that store and/or at the location of the triggering event within that time span. Data logger 50 may store the triggering event information to one or more device profiles that were detected during the triggering event. Further, triggering event information for associated device profiles may be used for future analysis, such as correlating them to future triggering events and recognizing possible patterns.

In one embodiment, data analyzer 52 may perform forensic analytics on device profiles 54 and other potential data generated through site loss prevention system 12 or RF survey system 14. Forensic analytics can be useful in cases where data acquired by incident survey system 10 can help apprehend or track individuals who are likely to have committed a crime. By identifying remote devices in the proximity of a triggering event, incident survey system 10 correlates sensor, monitor, or camera data with the place and time of the event. Upon request, captured information from the remote device can be matched to public database records and used to identify locations where the remote device has been observed. This enables law enforcement to track remote devices along previously captured routes, narrowing down the search for subjects involved in a triggering event.

In another embodiment, data analyzer 52 may perform predictive analytics. For example, once a remote device has been profiled, data collected from various incident survey system installations is used to help determine patterns of activity associated with the remote device 22; specifically, whether there are correlations to previous triggering events. For example, if a specific device profile is noted by the data analyzer to correlate to multiple triggering events, incident survey system 10 may indicate to loss prevention personnel of a raised risk level during the presence of remote device 22 at the location. Loss prevention personnel may then be proactively informed of the increased risk and where to focus their presence and surveillance efforts based on which RF receiving devices 20 most recently have detected remote device 22.

Figure 5:
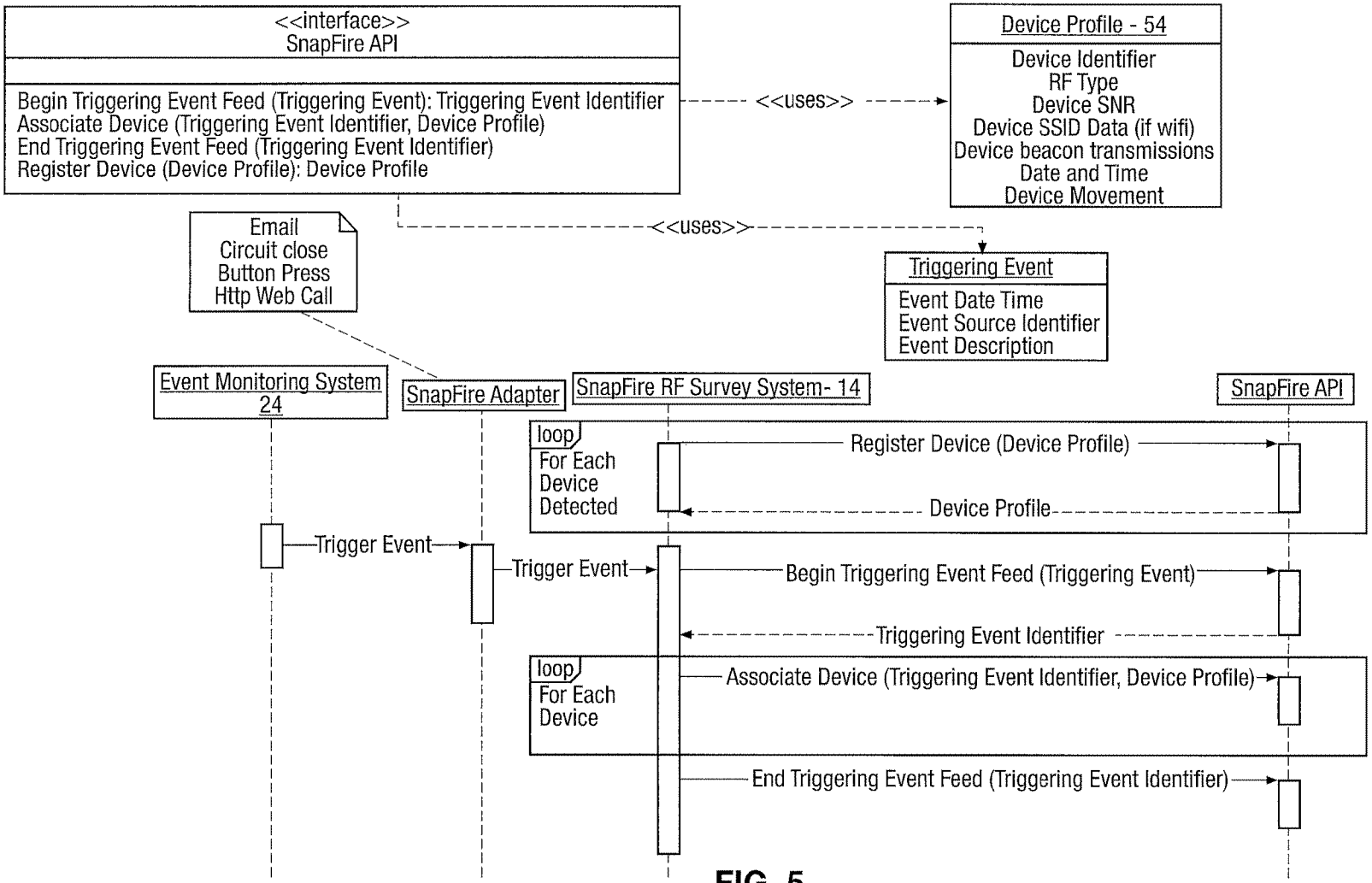
FIG. 5 is a block diagram illustrating one example of an interface connecting the site loss prevention system to the RF survey system.

FIG. 5 illustrates one embodiment of interface 16 comprising an application program interface (API). Data collected from incident survey systems installed at various locations are encrypted and sent to a shared database. In one embodiment, data is sent to the shared database via REST (Representational State Transfer) web services via SSL (Secure Sockets Layer) tunnel. The API may accept data from various embodiments and versions of an incident survey system and conform the data to a standard for input and return types defined by a technical team managing the shared database.

Figure 6:
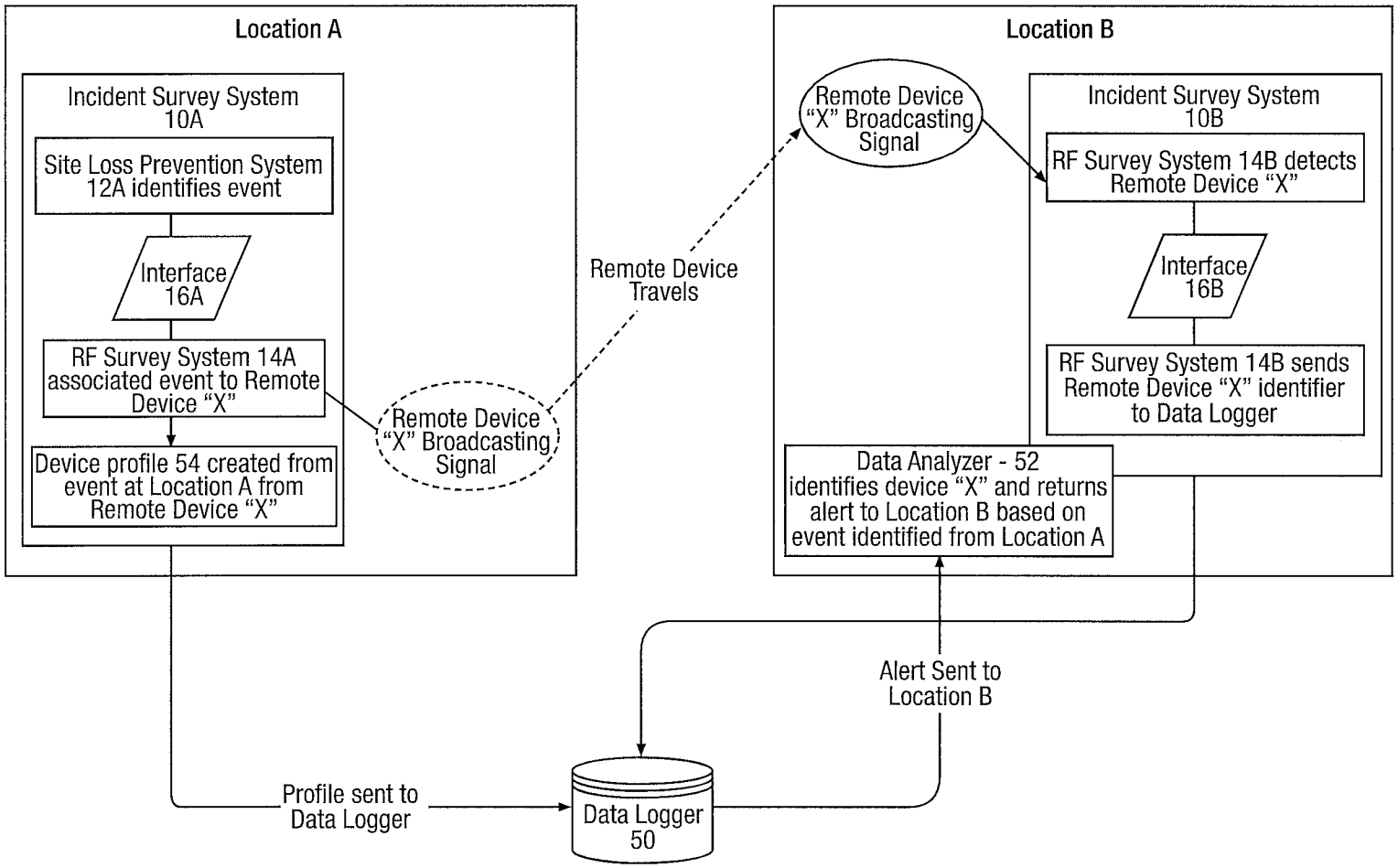
FIG. 6 is a block diagram illustrating an example of sharing a device profile between incident survey systems installed at separate locations.

Databases from an incident survey system installed at one location may be shared with one or more incident survey systems installed at other locations. An illustrative example is shown in FIG. 6, wherein an incident survey system 10*a* installed at location A detects a remote device 22 and associates its device profile 54 with a triggering event that is then shared with an incident survey system 10*b* installed at location B. As seen in FIG. 6, remote device 22 broadcasts a RF signal that is detected by RF survey system 14*a* to create a device profile stored in a shared database. As depicted, device profiles 54 are directly stored in shared database. However, in other embodiments, locations may have a local data logger that uploads device profiles to shared database.

In some embodiments, shared database may be limited to a few locations: for example, a shared database between several stores owned by a small franchise chain. In other embodiments, the shared database may be shared by numerous locations having separate incident survey systems. For instance, the shared database may comprise a subscription service offered to subscribers of a security service providing an incident survey system, wherein the shared database is accessible to all locations having an incident survey system with an active subscription.

Returning to FIG. 6, while remote device 22 is at location A, site loss prevention system 12*a* detects a triggering event, which is then associated with device profile 54 through interface 16*a*. Alternatively, the triggering event may not be determined until after remote device 22 has left location A. Subsequently, a person carrying remote device 22 enters location B having its own incident survey system 10*b* installed and connected to the shared database. As the RF survey system 14*b* of location B detects the presence of remote device 22, RF survey system 14*b* transmits the broadcasted data to shared database. Shared database then searches and determines whether there is a pre-existing device profile for remote device 22. If a device profile is unavailable, then one is created for remote device 22. In the example shown in FIG. 6, since remote device 22 has a pre-existing profile from visiting location A, shared database recognizes the device profile 54 and sends an alert to location B that remote device 22 is associated with a triggering event from location A. The alert from shared database may include or omit specific details of the triggering event and location. Once location B receives the alert associated with remote device 22, loss prevention personnel may then respond accordingly.

The incident survey system 10 may include a monitoring service 40 adapted to respond to a triggering event reported by site loss prevention system 12. For example, monitoring service 40 may be a remote monitoring system that is located off-site away from site loss prevention system 12. In some embodiments, monitoring service 20 may be adapted to execute a response to a triggering event automatically based on predefined conditions. As seen in FIG. 1, once an alert is generated, data from the triggering event may be disseminated to a monitoring service.

In one embodiment, monitoring service 40 is a managed service. For example, upon a triggering event, data provided by site loss prevention system 12 and RF survey system 14 is reviewed by a manned monitoring center located either locally or remotely. The service may make decisions regarding an appropriate response to the event based on either information gathered at the time of the triggering event or based on a predetermined set of criteria. The management service may also correspond with and notify an end user at the time of the triggering event.

In another embodiment, monitoring service 40 is an autonomous service. For example, upon a triggering event, data provided by site loss prevention system 12 and RF survey system 14 is reviewed by a manned monitoring center located either locally or remotely. The appropriate response to the triggering event is executed automatically based on predetermined criteria provided by the administrator of the incident survey system at that location. An automated notification process based on that criteria would disseminate the information regarding the event to the appropriate party.

In operation, incident survey system 10 may be installed at any type of location where security measures are desired, such as a retail or home location. The nature of the data collected by incident survey system 10 may be anonymous and consists of the unique identifiers of all remote devices in range, and the sensor that detected the device. The data may be retained for a specified retention period configured for each installation of incident survey system 10. Data analyzer analyzes data as it enters the data logger in real time and determines if remote devices in proximity to each location correlate to previous triggering events. The presence of remote devices linked to previous triggering events may cause the incident survey system to signal an alert to the user at the installation site and/or other monitoring services so that appropriate measures can be taken.

Certain modifications and improvements will occur to those skilled in the art upon a reading of the foregoing description. By way of example, the interface may comprise software that can be installed on any RF receiving device capable of reading MAC addresses and connecting to the shared database. It should be understood that all such modifications and improvements have been deleted herein for the sake of conciseness and readability but are properly within the scope of the following claims.

We claim:

1. A RF survey system for an incident survey system for a site loss prevention system including a trigger device adapted to detect a triggering event and to provide a signal in response to a triggering event and an event monitoring system adapted for providing an event output signal in response to receiving the signal from the trigger device, said RF survey system comprising:

(a) at least one device for receiving RF signals selected from the group consisting of Bluetooth, RFID, Wi-Fi, cellular transmissions, and combinations thereof broadcasted by remote devices having a unique MAC address when within a broadcast range of said remote devices, wherein said unique MAC address associates said remote device to an individual and wherein said RF survey system is adapted to display the status of said signals received by said RF signals receiving device; and (b) a data logger adapted for storing information received by said RF signals receiving device, said data logger further including a data analyzer for viewing and performing operations on information stored on said data logger, said data analyzer adapted to create a device profile associating a remote device and an individual with a triggering event and to assign risk levels of severity;

wherein said site loss prevention system further includes an interface for connecting said site loss prevention system to a RF survey system; said interface including a database for collecting the data provided by said event monitoring system and by said RF survey system, whereby the device profile of the remote devices are associated with the triggering event and said interface is adapted to provide an alert to an incident survey system.

2. The survey system of claim 1, wherein said RF signals receiving device includes a housing, an antenna, a power supply, at least one controller chip connected to RAM and ROM memory, and at least one network port.

3. The survey system of claim 1, wherein said survey system further includes LEDs which are adapted to report the status of said signals on said RF signals receiving device.

4. The survey system of claim 2, wherein said network port is a wide area network port.

5. The survey system of claim 1, wherein said interface comprises a transmitter connected to an output of said site loss prevention system and a receiver connected to an input of said RF signals receiving device.

6. The survey system of claim 5, wherein said transmitter and said receiver are wireless.

7. The survey system of claim 1, wherein said interface is connected to said site loss prevention system by an IP network.

8. The survey system of claim 7, wherein said network is a local network.

9. The survey system of claim 7, wherein said network is wireless.

10. The survey system of claim 1, wherein said interface is an applications program interface adapted to receive data from said RF signals receiving device and said site loss prevention system and send data to a monitoring service.

11. The survey system of claim 1, wherein said data logger is remotely located.

12. The survey system of claim 11, wherein said data logger stores information to a storage device at predefined time intervals.

13. The survey system of claim 1, wherein said data analyzer associates information received from said site loss prevention system with said remote device profile.

14. The survey system of claim 1, wherein said remote device profile is stored in a database.

15. The survey system of claim 14, wherein said database is shared and accessible to at least one other remote incident survey system.

16. The survey system of claim 15, wherein said RF signals receiving device detects said remote device having said device profile created by said other remote incident survey system.

17. The survey system of claim 1 further including a user interface for performing tasks with said data analyzer.

18. The survey system of claim 17, wherein said user interface includes a camera specific overlay.

19. The survey system of claim 17, wherein said user interface is a site specific overlay.

20. An incident survey system comprising:

(a) a site loss prevention system including (i) a trigger device adapted to detect a triggering event, and to provide a signal in response to said triggering event and (ii) an event monitoring system adapted for providing an event output signal in response to receiving the signal from said trigger device;

(b) a RF survey system including (i) at least one device for receiving RF signals selected from a group consisting of Bluetooth, RFID, Wi-Fi, cellular transmissions, and combinations thereof broadcasted by remote devices having a unique MAC address when within a broadcast range of said remote devices, wherein said unique MAC address associates said remote devices to an individual and wherein said RF survey system is adapted to display the status of said signals received by said RF signals receiving device and (ii) a data logger adapted for storing information received by said RF signals receiving device, said data logger including a data analyzer for viewing and performing operations on information stored on said data logger, said data analyzer adapted to create a device profile associating a remote device and an individual with a triggering event and to assign risk levels of severity;

(c) an interface for connecting said site loss prevention system to said RF survey system; said interface including a database for collecting the data provided by said event monitoring system and by said RF survey system, whereby the device profile of the remote devices are associated with the triggering event and said interface is adapted to provide an alert to an incident survey system; and d) a monitoring service for responding to said triggering event reported by said site loss prevention system.

21. The survey system of claim 20, wherein said monitoring service is a remote monitoring system located off-site from said site loss prevention system.

22. The survey system of claim 20, wherein said monitoring service is adapted to execute a response to said triggering event automatically based on predefined conditions.

23. The survey system of claim 20, wherein said monitoring service shares information from said triggering event with another remote site.

24. The survey system of claim 20, wherein said monitoring service provides analytical and predictive reporting on data collected from said triggering event.

25. The survey system of claim 20, wherein said at least one trigger device includes a plurality of sensors.

26. The survey system of claim 25, wherein said sensors are selected from the group consisting of electronic article surveillance sensors, fire detector sensors, motion sensors, glass break sensors, magnetic sensors, smoke detector sensors, water flow sensors, HVAC monitor sensors, heat sensors, duct air flow sensors, temperature sensors and combinations thereof.

27. The survey system of claim 20, wherein said site loss prevention system includes at least one surveillance camera adapted to receive video signals and relay said video signals to said event monitoring system.

28. The survey system of claim 20, wherein said RF signals receiving device includes a housing, an antenna, a power supply, at least one controller chip connected to RAM and ROM memory, and at least one network port.

29. The survey system of claim 20, wherein said survey system further includes LEDs which are adapted to report the status of said signals on said RF signals receiving device.

30. The survey system of claim 28, wherein said network port is a wide area network port.

31. The survey system of claim 20, wherein said interface comprises a transmitter connected to an output of said site loss prevention system and a receiver connected to an input of said RF signals receiving device.

32. The survey system of claim 31, wherein said transmitter and said receiver are wireless.

33. The survey system of claim 20, wherein said interface is connected to said site loss prevention system by an IP network.

34. The survey system of claim 33, wherein said network is a local network.

35. The survey system of claim 33, wherein said network is wireless.

36. The survey system of claim 20, wherein said interface is an applications program interface adapted to receive data from said RF signals receiving device and said site loss prevention system and send data to a monitoring service.

37. The survey system of claim 20, wherein said data logger is remotely located.

38. The survey system of claim 37, wherein said data logger stores information to a storage device at predefined time intervals.

39. The survey system of claim 20, wherein said data analyzer associates information received from said site loss prevention system with said remote device profile.

40. The survey system of claim 20, wherein said remote device profile is stored in a database.

41. The survey system of claim 40, wherein said database is shared and accessible to at least one other remote incident survey system.

42. The survey system of claim 41, wherein said RF signals receiving device detects said remote device having said device profile created by said other remote incident survey system.

43. The survey system of claim 34 further including a user interface for performing tasks with said data analyzer.

44. The survey system of claim 43, wherein said user interface includes a camera specific overlay.

45. The survey system of claim 43, wherein said user interface is a site specific overlay.

* * * * *